United States Patent [19]

DeLorean et al.

[11] 4,074,117

[45] Feb. 14, 1978

[54] TIMING SYSTEM

[75] Inventors: Jack Z. DeLorean, Bloomfield Hills; David C. Bacon, East Detroit, both of Mich.

[73] Assignee: Grand Prix of America, Inc., Birmingham, Mich.

[21] Appl. No.: 680,415

[22] Filed: Apr. 26, 1976

Related U.S. Application Data

[63] Continuation of Ser. No. 458,175, April 5, 1974, abandoned.

[51] Int. Cl.[2] ..... G04F 10/00

[52] U.S. Cl. ..... 235/92 T; 235/92 GA; 235/92 R; 340/23; 340/323 R; 324/186

[58] Field of Search ..... 235/92 T, 92 PB, 92 CC, 235/92 TC, 92 GA, 92 PK; 340/23, 104, 323 R; 58/145 A; 246/108, 167 D; 324/186

[56] References Cited

U.S. PATENT DOCUMENTS

| | | | |
|---|---|---|---|
| 3,546,696 | 12/1970 | Waters et al. | 340/23 |
| 3,656,060 | 4/1972 | Bauernfeind et al. | 235/92 PB |
| 3,748,580 | 7/1973 | Stevens et al. | 235/92 T |
| 3,771,463 | 11/1973 | Smodt et al. | 246/108 |
| 3,790,720 | 2/1974 | Schartmann | 235/92 PB |
| 3,795,907 | 3/1974 | Edwards | 235/92 T |
| 3,835,950 | 9/1974 | Asano et al. | 246/167 D |
| 3,860,798 | 1/1975 | Kemper | 235/92 PB |

*Primary Examiner*—Joseph M. Thesz

[57] ABSTRACT

Method and apparatus for timing a plurality of participants or their vehicles to complete a designated course, and for automatically starting the participants at spaced time intervals derived in part from respective sample times taken by the immediately preceding participants to cover a selected portion of the course. Sensors at start, finish, and intermediate positions monitor the progress of each participant on the course; a crystal oscillator is selectively connected to a plurality of electronic counters to accumulate an elapsed time for each of a plurality of participants; and a digital display device displays the times of participants as they complete the course. When each participant starts, a program counter is counted upwardly from zero until a selected time delay is reached, is then reset to zero and counted upwardly again until the participant reaches the intermediate position, and is then counted downwardly to zero at a different counting rate before a starting sequence is initiated to signal the next participant to start. "Foul starts" are also detected and indicated by the system, and manual controls are included to adjust, test, or override automatic starting operations.

23 Claims, 8 Drawing Figures

Fig. 1
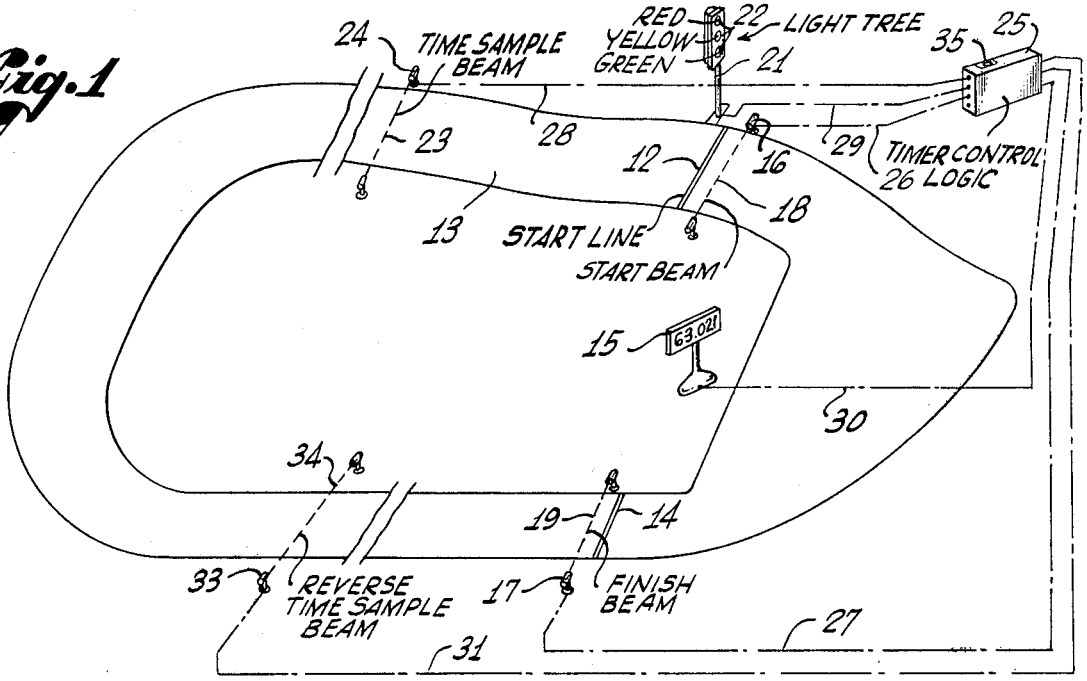
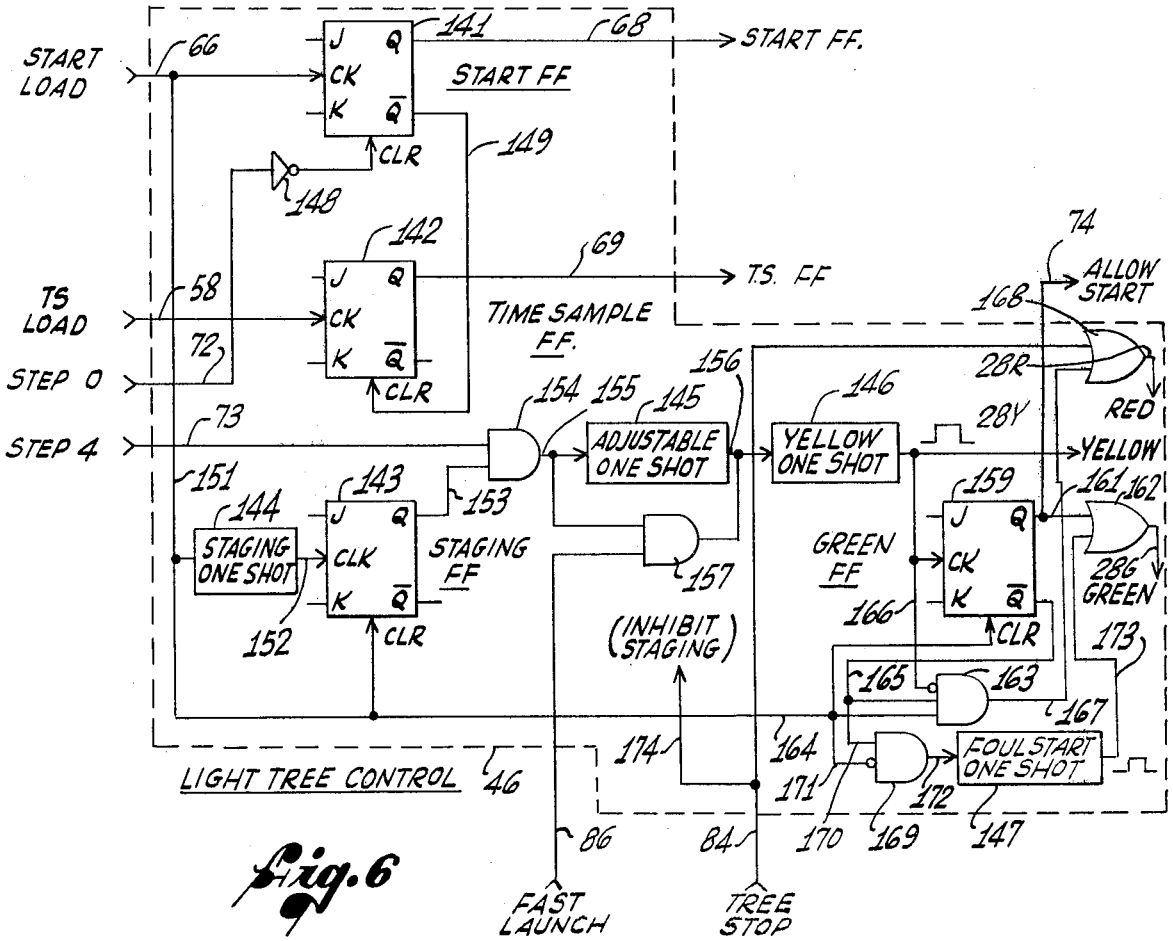
Fig. 6

TIMING SYSTEM

This is a continuation of application Ser. No. 458,175, filed Apr. 5, 1974, now abandoned.

BACKGROUND OF THE INVENTION

This invention relates generally to timing systems for sporting events and recreational activities, and, more particularly, to timing systems for such events and activities in which participants traverse a designated course after being released one by one from a starting position on the course. For example, certain skiing events are of this general character, as is a popular recreational activity whereby members of the public drive racing vehicles which are started one by one and timed over a lap of a specially constructed course.

Clearly, in any such sporting event or activity, one important requirement is that the starting times of the participants be optimally spaced. If the spacing is too close, there may be unwanted, and perhaps disastrous interference between participants, and a more complicated timing system is required. However, if the spacing is too great, the course is inefficiently utilized, and, although this inefficiency might be of little consequence in a skiing event, it is of great importance in a more commercial activity, such as the timed racing of motor vehicles.

Timing systems already available are capable of timing several competitors simultaneously and displaying the measured times, but none addresses the problem of optimally spacing the competitors on the course. Consequently, there is a definite need for a timing system overcoming this problem and having the capability of accurately and reliably timing a number of participants simultaneously on the course, and displaying each participant's elapsed time on completion of the course. The present invention satisfies this need.

SUMMARY OF THE INVENTION

The present invention resides in a method and apparatus for timing a plurality of participants over a designated course, and automatically starting the participants at spaced time intervals derived from respective sample times taken by the immediately preceding participants to cover a selected portion of the course. In this way, the spacing of each participant behind the immediately preceding participant is dependent in part on the preceding participant's speed as actually measured by the sample time.

Basically, and in general terms, the apparatus of the present invention comprises sensing means for detecting participants at selected positions in the course, timing means for obtaining the sample times for each participant, and control means for automatically starting the participants at spaced intervals derived from the respective sample times of the immediately preceding participants. Also included are storage means for accumulating an elapsed time for each participant on the course, and display means for automatically recording the elapsed time of each participant completing the course.

More specifically, in a presently preferred embodiment of the invention adapted for use in timed motor vehicle racing, the sensing means are photoelectric devices at a start position, a finish position, and at least one selected intermediate position. A memory sequencer circuit, responsive to signals from the photoelectric devices, generates appropriate signals to control the storage means by starting or stopping the accumulation of a time count, or by displaying the contents of an appropriate segment of the storage means.

The control means in the preferred embodiment also includes an electric light standard, or "tree" as it is sometimes known, bearing various colored signal lights to control the starting or "staging" of each vehicle. The lights are themselves controlled, in part, by an arrangement of control logic which includes a "program counter" and a "control counter." When a vehicle starts from the start position, the program counter is incremented or counted up until the vehicle reaches the selected intermediate position in the course. This measures the sample time for that vehicle. Then the program counter is counted down, but at a slower rate. The control counter governs this sequence of steps on the program counter and initiates the switching of appropriate lights on the tree to start the next vehicle when the sequence is complete. The sequence may also include a selectable delay time before the program counter begins measuring the sample time, and a further delay may be included after the count-down of the program counter is complete.

The apparatus of the preferred embodiment includes manual controls for resetting the memory sequencer in the event that vehicles get out of their starting sequence, for forcing the tree lights to a stop condition to prevent further vehicle staging, and for selecting or deselecting the available adjustable delays in the staging sequence. Also included in the preferred embodiment is a circuit for detecting and indicating "foul" starts, i.e. by vehicles leaving the start position before receiving a start signal.

In accordance with other aspects of the invention, means are provided for eliminating spurious signals from the start and finish positions, generated as various parts of the vehicles actuate the photo-electric devices; for running the apparatus of the invention in a "test" mode in which the photo-electric devices may be simulated and the conditions of various circuit elements are visibly indicated; and for controlling the display means to display each vehicle's lap time for a selectable maximum time and for a minimum time, even if sugsequent vehicles finish the course before the minumum time has elapsed.

Basically, the method of the present invention includes the steps of timing a vehiicle over a selected portion of the course to obtain a measure of its speed, then delaying the staging of the next vehicle by a time interval derived in part from the speed of the preceding vehicle, and in part from at least one adjustable time delay. More specifically, the method includes starting a first vehicle, waiting for an adjustable time delay to elapse, measuring the sample time taken for the first vehicle to reach the intermediate position in the course, waiting for a further period derived from the sample time, and then initiating a starting sequence for a second vehicle.

It will be apparent from the foregoing the the present invention is a significant improvement over previously available timing systems for events and activities of the type described. In particular, the spacing of participants or vehicles can be automatically and adjustably controlled. Furthermore, the timing system of this invention includes the means for detecting foul starts, and it is accurate, reliable, and easy to maintain. Other aspects and advantages of the invention will become apparent from the following more detailed description taken in conjunction with the accompanying drawings.

BRIEF DESCRIPTION OF THE DRAWINGS

FIG. 1 is a perspective, diagrammatical view of a motor vehicle racing track incorporating the timing system of the present invention;

FIG. 6 is a logic diagram of the light tree control included in FIG. 2;

DESCRIPTION OF THE PREFERRED EMBODIMENT

Figure 2:
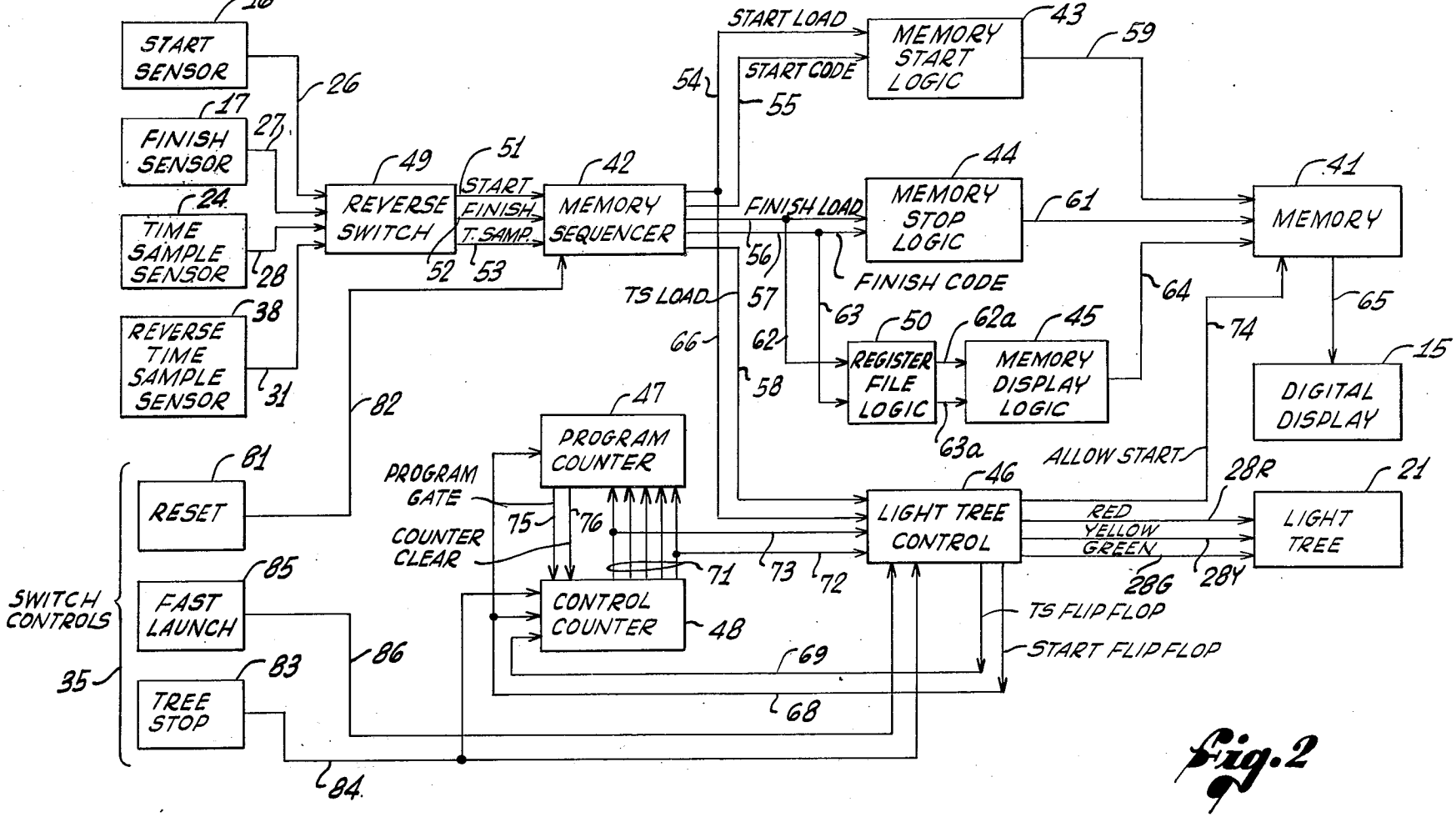
FIG. 2 is a block diagram of the timing system shown in FIG. 1.

As is shown in the drawings for purposes of illustration, the present invention is well suited for controlling and timing motor vehicles on a specially constructed course, and, in particular, for starting the vehicles automatically to provide optimum spacing between them. FIG. 1 is a prespective, diagrammatical view showing various components of the invention installed at a vehicle racing track. Motor driven racing vehicles (not shown), typically scaled down in size and power from full sized racing cars, are started one by one from a start line 12 on the specially constructed course 13, and are timed over one lap of the course until they reach a finish line 14, after which the lap time of each finishing vehicle is displayed in a digital display device 15. The lap times are determined from information derived from conventional photo-electric devices 16 and 17 located near the start line 12 and the finish line 14, respectively. A start beam 18 and a finish beam 19 are broken by the presence of a vehicle near the start line 12 or the finish line 14, and the lap time for each vehicle is determined using circuitry responsive to signals from the photo-electric devices 16 and 17.

In order to utilize the course 13 as efficiently as possible, the vehicles should be optimally spaced as closely as possible without unduly risking interference between successive vehicles. A light standard 21, or "tree" carrying various colored lights 22 is typically used near the start line 12 to control the starting or "staging" of vehicles, but, until now, the staging sequence has had to be manually controlled or initiated.

In accordance with the present invention, the vehicles are automatically started at spaced time intervals derived from respective sample times taken by the immediately preceding participants to cover a selected portion of the course 13. In the presently preferred embodiment of the invention, a time sample beam 23 and an associated additional photo-electric device 24 are located at a point in the course intermediate the start line 12 and the finish line 14, typically one-tenth of the course distance from the start line. Timer control logic 25 receives signals from the photo-electric devices 16, 17 and 24 over lines 26, 27 and 28, respectively, and sends signals over line 29 to control the lights 22 on the light tree 21. The timer control logic 25 automatically controls the lights 22 to start a vehicle after a time delay based in part on the sample time of the preceding vehicle, and in part on an adjustable constant delay.

The timer control logic 25 also transmits signals over line 30 to the digital display 15 as each vehicle breaks the finish beam 19, and may be conditioned to receive signals over line 31 from yet another photo-electric device 33 responsive to a reverse time sample beam 34. The reverse time sample beam 34 is located a preselected distance from the finish line 14, and is used when it is desired to race the vehicles in an opposite direction around the course 13.

The timer control logic 25 accumulates elapsed times for each of a plurality of vehicles on the course 13 simultaneously, and displays in the digital display 15 the lap time of each vehicle as it crosses the finish line 14. The timer control logic 25 has manual controls 35 to reset the control logic should the vehicles get out of their starting sequence, to force the lights 22 to a red condition to prevent further automatic vehicle staging, and to select and adjust various constant delays built into the system.

FIG. 2 is an overall block diagram illustrating signal flow between the various components of the timing system of the invention. It will be seen that, in addition to the components mentioned in connection with FIG. 1, the system includes a memory 41, a memory sequencer 42, memory start logic 43, memory stop logic 44, memory display logic 45, light tree control logic 46, a program counter 47, a control counter 48, a reverse switch 49, and a register file 50. The reverse switch 49 is only used if it is desired to reverse the direction in which the vehicles move around the course 13. It has the effect of reversing the relative significance of signals from the start beam photocell 16 and the finish beam photocell 17, and of selecting the signal from the reverse time sample beam photocell 38 rather than the usual time sample beam photocell 24. This reversing function is accomplished by conventional means, and is not, in itself, of great significance to the present invention.

In brief, the memory sequencer 42, in response to signals from the photo-electric devices 16, 17 and 24, generates signals used to control the selection and operation of appropriate segments of the memory 41, to accumulate elapsed times for the vehicles on the course 13. The program counter 47 and control counter 48 together compute a delay derived in part from the time taken by a vehicle to reach the time sample beam 23. When the delay has elapsed, a signal is transmitted to the light tree control logic 46, to initiate a staging sequence for the next vehicle.

More specifically, the memory sequencer 42 receives from the reverse switch 49 a "start" signal over line 51, a "finish" signal over line 52, and a "time sample" signal over line 53. The memory sequencer 42 performs certain pulse filtering operations on the received signals, and generates a "start load" signal on line 54, "start code" signals on line 55, a "finish load" signal on line 56, "finish code" signals on line 57, and a "time sample load" signal on line 58. A high "start load" signal indicates a broken start beam and the presence of a vehicle at the start line 12 (FIG. 1), and the "start code" signals define an identifier assigned to the vehicle detected at the start line by the memory sequencer 42. Similarly, a high "finish load" signal indicates a broken finish beam and the presence of a vehicle at the finish line 19 (FIG. 1), and the "finish code" signals define the identifier associated with that vehicle, as assigned by the memory sequencer 42.

The memory start logic 43 receives the "start load" signal and the "start code" signals over lines 54 and 55 respectively, and outputs a signal over line 59 to instruct an appropriate segment of the memory 41 to begin accumulating a time count. Similarly, the "finish load" signal and the "finish code" signals are used by the memory stop logic 44 to select an appropriate segment of the memory 41 and to transmit a "stop" signal to that segment over line 61. The "finish load" and "finish code" signals are also transmitted, over lines 62 and 63 respectively, to the register file logic 50, and thence over lines **62*a* and 63*a*, respectively, to the display memory logic 45. On receiving a "finish load" signal, the display memory logic 45 transmits a control signal to the memory 41 over line 64 to initiate a transfer of the contents of a memory segment to the digital display 15 over line 65**.

The register file logic 50 operates as a buffer for "finish load" and "finish code" signals indicating that vehicles have reached the finish line, so that these signals will be presented to the memory display logic 45, over lines **62*a* and 63*a*, and will be spaced by some minimum time period, such as five seconds. Thus, if a first vehicle crosses the finish line, its lap time will be displayed for at least five seconds. The "finish code" signals of a second vehicle finishing before the five seconds have elapsed are held temporarily in the register file logic 50. This logic 50** includes a register file of conventional design, such as type number SN74170 manufactured by Texas Instruments, Inc., Dallas, Texas, together with appropriate control and timing logic for writing into and reading from the file in a conventional manner.

The light tree 21 receives control signals from the light tree control logic 46 over lines 28R, 28Y, and 28G to control operation of its red, yellow and green lights, respectively. The light tree control logic 46 also receives the "start load" and "time sample load" signals from the memory sequencer 42 over lines 66 and 58, respectively, and generates additional control signals designated a "start flip-flop" signal and a "time sample flip-flop" signal, to be discussed in detail in connection with FIG. 6. In brief, these two signals indicate when a vehicle has departed from the start line 12 (FIG. 1) and when the time sample beam 23 (FIG. 1) has been broken and remade. These signals are conveyed to the control counter 48 over lines 68 and 69, respectively, and are used to control progression of the control counter through a number of steps in a delay sequence, each step being represented by one of the output signals 71 from the control counter to the program counter 47. Signals indicating the first and last steps in the sequence are transmitted to the light tree control logic 46 over lines 72 and 73 respectively.

In general terms, the operation of the invention as illustrated in FIG. 2 can be described as follows. When the first vehicle to be started is positioned to break the start beam 18 (FIG. 1), a "start load" signal is received by the light tree control logic 46 over the line 66, and a succession of lights, red, yellow, then green, is displayed on the light tree 21 to allow the first vehicle to start. As the vehicle moves away from the start beam 18 (FIG. 1), the "start load" signal falls as the beam is remade, and the memory start logic 43 signals a first segment of the memory 41 to begin counting, but only if a green light signal was given to the vehicle, as indicated by the signal on line 74 from the light tree control logic 46 to the memory 41.

A falling "start load" signal operates through the light tree control logic 46 to step the control counter 48 which, in turn, starts the program counter 47 running until a preset fixed time delay is reached. When this occurs the program counter 47 generates a "program gate" signal on line 75 to the control counter 48. Then the program counter 47 is cleared and begins counting again until the first vehicle breaks and remakes the time sample beam 23 (FIG. 1), after which the program counter is counted down at a slower rate until zero is reached. This condition is conveyed to the control counter 48 by a "counter clear" signal transmitted over line 76, which advances the control counter to the final step in the delay sequence and allows the light tree control logic 46 to signal a second vehicle to start. When a vehicle breaks the finish beam 19 (FIG. 1), the memory stop logic 44 stops counting in the appropriate segment of the memory 41, and the memory display logic 45 retrieves the contents of that segment for display on the digital display 15.

Should the vehicles get out of their original starting sequence, the memory sequencer 42 may be reset to a starting condition by one of the switch controls 35, a reset button 81 which transmits a "reset" signal to the memory sequencer 42 over line 82. A tree stop switch 83 is connected to the light tree control logic 46 and the control counter 48 by line 84, to force the display of a red light on the light tree 21 and to thereby prevent staging of further vehicles until the course 13 is clear and the memory sequencer 42 can be reset. Also available is a fast launch switch 85 connected by line 86 to the light tree control logic 46 to select or deselect an additional delay time built into the light tree control logic 46.

The foregoing description of FIG. 2 gives an overview of the system and its operation. FIGS. 3–8 illustrate various components of the system now to be described in greater detail.

Figure 3:
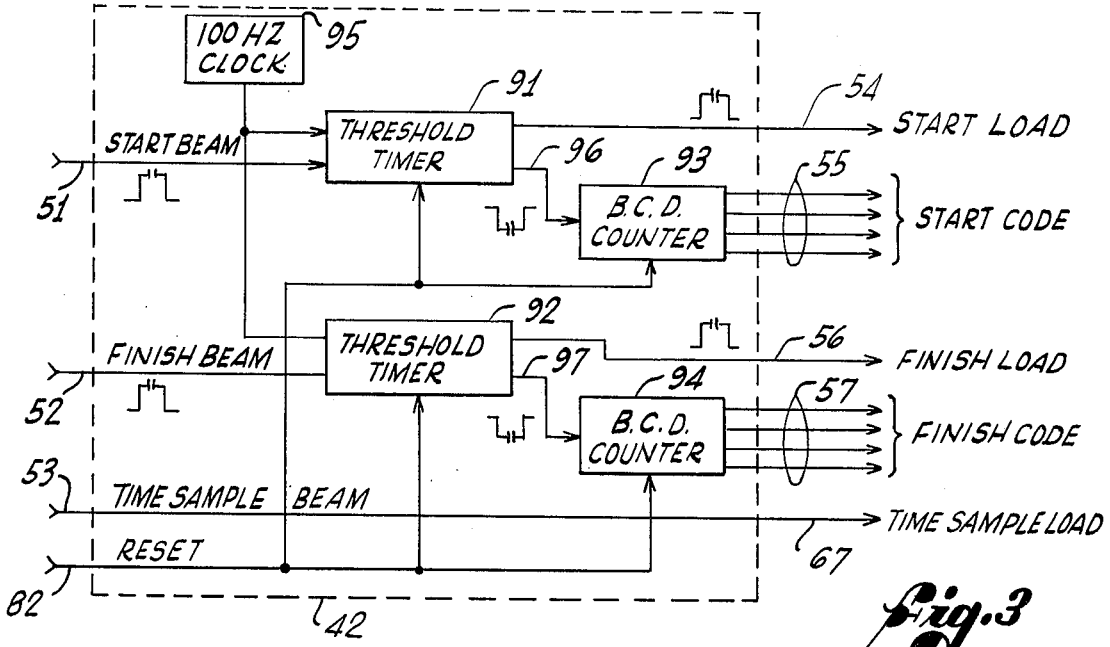
FIG. 3 is a block diagram of the memory sequencer included in FIG. 2.

The memory sequencer 42 is illustrated in FIG. 3 and includes two threshold timers 91 and 92, two binary coded decimal (BCD) counters 93 and 94, and a 100 Hz. clock 95. It will be appreciated that, although several clocks of various frequencies are mentioned throughout this description, in practice these clock signals would be derived from a single crystal oscillator connected with counters of conventional design to generate the desired clock frequencies.

The function of each threshold timer 91 and 92 is to eliminate possible spurious signals on the lines 51 and 52 from the start beam photocell and finish beam photocell 16 and 17, respectively. These spurious signals can arise when one of the beams is broken and remade by parts of a moving vehicle, resulting in several signals being generated by one vehicle. If the spurious signals, which are generally of short duration, are not discarded, the memory sequencer 42 would erroneously assign multiple start and finish codes to the same vehicle. In the illustrative embodiment, if, for example, a signal on line 51 from the start beam photocell 16 goes high, indicating a broken beam, for less than some preselected period, say 80 milliseconds, the threshold timer 91 will not generate a high "start load" signal on line 54. Similarly, if the signal on line 51 falls, and stays low for less than a preselected time period, the "start load" signal on line 54 will not fall.

Thus, the threshold timers 91 and 92, in conjunction with the 100 Hz. clock 95 act as a pulse filter for signals on the lines 51 and 52, and produce "start load" signals on line 54 and "finish load" signals on line 56, as well as the inverse of these signals on lines 96 and 97 respectively. These inverse signals are used as inputs to the respective BCD counters 93 and 94, which, in the presently preferred embodiment of the invention, are conventional BCD counters with a range of 0–9.

Whenever the start beam 18 (FIG. 1) is broken for 80 milliseconds or more, the falling, leading edge of the inverse "start load" signal generated on line 96 advances the BCD counter 93 and generates the "start code" on the lines 55 at the output of the counter 93. The "start code" is essentially a vehicle number assigned to the vehicle presently at the starting position, and this number will be incremented as each subsequent vehicle is positioned to break the start beam. Similarly, when the finish beam 19 (FIG. 1) is broken for more than 80 milliseconds the falling, leading edge of the inverse "finish load" signal generated on line 97 advances the BCD counter 94 and generates the "finish code" on lines 57 output from the BCD counter 94. Both the counters 93 and 94 cycle continuously from "0" through "9", to accommodate ten vehicles simultaneously in the illustrative embodiment, and are reset only by a reset signal on line 82, which also acts to reset logic in the threshold timers 91 and 92.

Figure 5:
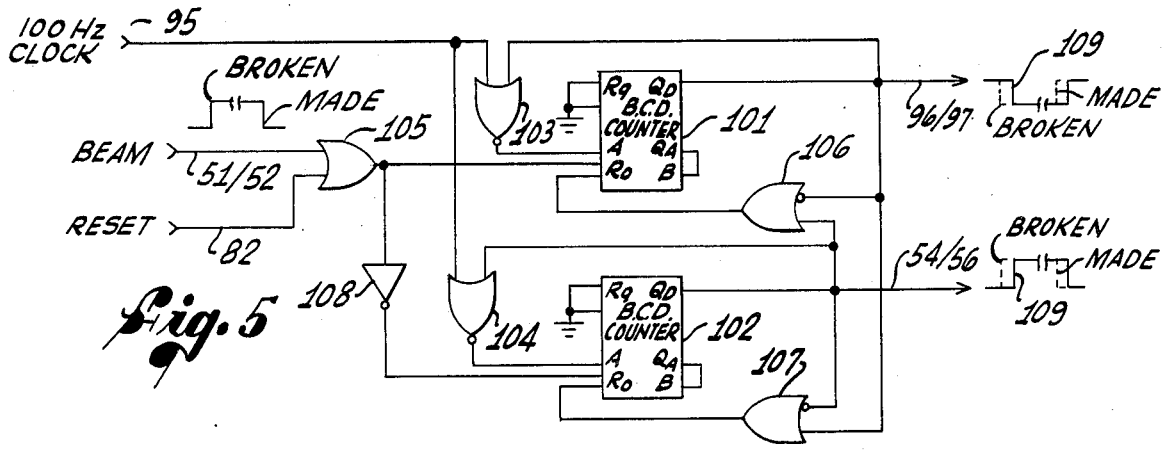
FIG. 5 is a logic diagram of the threshold timers included in FIG. 3.

The threshold timers 91 and 92 may be of any suitable logical design, and FIG. 5 illustrates a threshold timer design used in the presently preferred embodiment of the invention. It includes an arrangement of two BCD counters 101 and 102 for counting 10 millisecond pulses from the clock 95, two NOR gates 103 and 104, three OR gates 105–107, and an inverter 108. The counters 101 and 102 are conventional decade counters such as type SN7490, manufactured by Texas Instruments, Inc., Dallas, Texas. As shown by the output wave forms at 109, the output signals from the threshold timers 91 and 92 lag the actual breaking and remaking of a beam by a fixed delay, in this case 80 milliseconds. Of course, this introduces no timing inaccuracy, because the delay is introduced both at the start and the finish.

Figure 4:
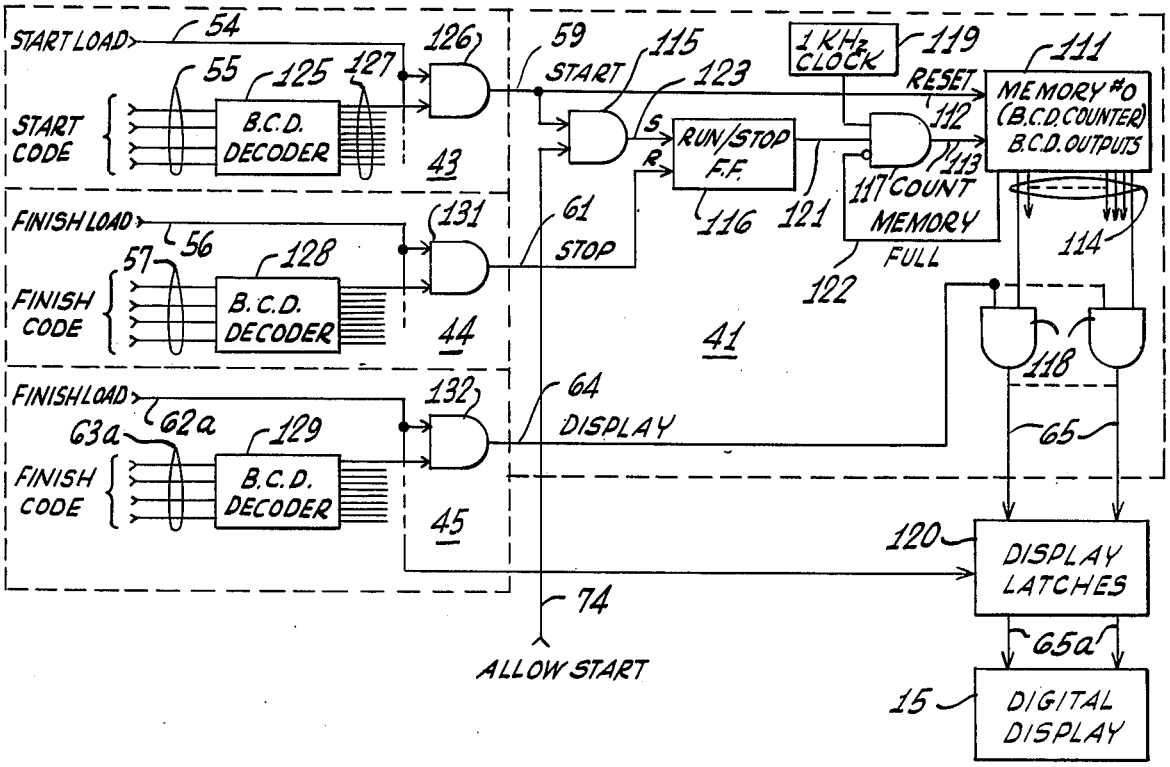
FIG. 4 is a logic diagram of the memory, memory start logic, memory stop logic, and memory display logic included in FIG. 2.

FIG. 4 illustrates the memory 41 and the memory start, stop, and display logic 43–45 in more detail. In the presently preferred embodiment of the invention, the memory 41 comprises ten memory segments, only one of which is illustrated in FIG. 4. Each of the segments includes a BCD counter 111 of conventional design, with a reset input 112, a count input 113, and a plurality of BCD outputs 114 representing five decimal digits. Each segment of memory also includes an AND gate 115, a run-stop flip-flop 116, a second AND gate 117, and twenty output AND gates 118, of which only two are shown. A 1 kilohertz clock 119 supplies clock pulses to the AND gate 117, which allows the clock pulses through to the count terminal 113 only if the run-stop flip-flop 116 is set to a "run" condition, as indicated by a signal on line 121, and if the BCD counter 111 is below its full capacity, as indicated by a signal on line 122.

The AND gate 115 receives one input from the memory start logic 43 over the line 59 and a second input over the line 74 from the light tree control logic 46 (FIG. 2), indicating that a green light is present on the light tree 21 (FIG. 2). Line 59 from the memory start logic 43 is connected to the reset input 112 of the BCD counter 111 as well as to the AND gate 115; line 61 from the memory stop logic 44 is connected to the reset terminal of the run-stop flip-flop 116; and line 64 from the memory display logic 45 is connected to one input of each of the output AND gate 118.

It will be seen that, when a start signal is present on line 59 and a signal is also present on line 74, the AND gate 115 generates an output signal on line 123 to set the run-stop flip-flop 116 to the "run" condition. Similarly, when a signal is present on the line 61 from the memory stop logic 44, this has the effect of resetting the run-stop flip-flop 116 and thereby preventing further counting into the BCD counter 111. Finally, if a signal is present on the line 64, from the memory display logic 45, this has the effect of enabling the output gates 118 and transferring the contents of the BCD counter 111 to the digital display 15 over lines 65.

It will be apparent that, since the display-initiating signal on line 64 persists only for the duration of the "finish load" signal on line **62*a*, some form of latching circuitry is required, as indicated by the display latches 120. The latches 120 are of conventional design and are enabled by a "finish load" signal on line 62*a* to hold the signals received from a BCD counter 111 over lines 65, and to transmit them to the digital display 15 over lines 65*a*. A timing ciruit (not shown) may also be provided to blank the display 15** after some selectable maximum period.

It should be emphasized that there are, in fact, ten BCD counters 111 in the illustrative embodiment, and ten corresponding start signal lines 59, ten stop signal lines 61, and ten display signal lines 64. The selection of a memory segment to start counting is governed by the "start code" signals on lines 55, and the selection of a memory segment to stop and display is governed by the "finish code" signals on lines 57 and **63*a*, respectively. The memory start logic 43 includes a BCD decoder 125 and a plurality of AND gates 126. The decoder 125 has ten output lines 127, only one of which is energized depending on the BCD "start code" input to the decoder over lines 55. Each of the output lines 127 is connected to one input of a corresponding one of the AND gates 126, the second input of these AND gates being commonly connected to the "start load" signal on line 54. Thus, whenever a "start load" signal appears on line 54 and a "start code" appears on lines 55, a corresponding one of the output lines 127 is energized, and this, in turn, generates a signal on the line 59 corresponding to the memory segment selected by the "start" code on lines 55**.

There are similar BCD decoders 128 and 129 and corresponding pluralities of AND gates 131 and 132 in the memory stop logic 44 and the memory display logic 45, respectively. These operate in a similar fashion to the corresponding elements in the memory start logic, in that a "finish load" signal on lines 56 and **62*a* together with a "finish code" on lines 57 and 63*a* will generate a stop signal on the line 61 corresponding to the selected segment of memory, and a display signal on the line 64** corresponding to the same selected segment.

As was mentioned earlier, the "start load" and "time sample load" signals generated by the memory sequencer 42 (FIG. 2) are also transmitted to the light tree control logic 46 (FIG. 2) over lines 66 and 58, respectively. The light tree control logic 46 (FIG. 2), as illustrated in detail in FIG. 6, includes three flip-flops, designated as a start flip-flop 141, a time sample flip-flop 142, and a staging flip-flop 143. Also included are four monostable multivibrators or one-shots, designated as a staging one-shot 144, an adjustable one-shot 145, a yellow one-shot 146, and a foul start one-shot 147. The flip-flops 141–143 are conventional "J-K" flip-flops connected with the "K" terminals grounded and the "J"

terminals held at a high level so that the flip-flop is set by a falling clock signal together with a high level clear signal, and is reset by a low level clear signal. The "start load" signal on line 66 is connected to the clock terminal of the start flip-flop 141. Line 72 from the control counter 48 (FIG. 2), indicating whether the control counter is at a step designated "step zero", is connected to the clear terminal of the start flip-flop 141, through an inverter 148.

As will be later appreciated from a discussion of a control counter 48 (FIG. 2), "step zero" is the first step of the delay sequence, i.e., when the program counter 47 (FIG. 2) is counting upwardly to a fixed time delay. Consequently, as long as the control counter 48 (FIG. 2) has passed step zero, there will be a high level clear signal on the start flip-flop 141. A falling "start load" signal on line 66, caused by a vehicle leaving the start position, will therefore, set the start flip-flop 141 and generate a high level output on line 68. The start flip-flop 141 is cleared again almost immediately, since the "start flip-flop" signal on line 68 causes the control counter 48 (FIG. 2) to advance to a step zero condition again, as will be apparent when the control counter is discussed in detail.

The inverse output from the start flip-flop 141 is connected to the clear terminal of the time sample flip-flop 142 over line 149. Thus, the momentary setting of the start flip-flop 141 operates to clear the time sample flip-flop 142. A falling "time sample load" signal on line 58, caused by breaking and remaking of the time sample beam 23 (FIG. 1), operates to set the time sample flip-flop 142, thereby generating a "time sample flip-flop" signal on line 69, which is lowered when the start flip-flop 141 is set.

The start flip-flop 141 and the time sample flip-flop 142 generate signals used by the program counter 47 and control counter 48 (FIG. 2). In brief, the start flip-flop 141 is set when a vehicle leaves the start position and is reset shortly thereafter; and the time sample flip-flop 142 is set when the time sample beam 23 (FIG. 1) is broken and remade, and reset when the next vehicle leaves the start position.

The "start load" signal on line 66 is also connected to the staging one-shot over line 151, the output of which is connected to the clock terminal of the staging flip-flop 143 over line 152. The staging one-shot 144 is connected so that the rising "start load" signal on lines 66 and 151 causes a positive-going pulse to be generated on line 152. In the preferred embodiment, this pulse is designed to be approximately 1.5 seconds in duration, and, as will be seen, it results in a red light signal for this length of time. When the output pulse on line 152 falls, the staging flip-flop 143 is set. Its output signal on line 153 is ANDed with a "step 4" signal on line 73 from the control counter 48 (FIG. 2) in an AND gate 154. As will be seen, a "step 4" signal on line 73 indicates that the delay sequence is complete, and, until a "step 4" signal is received, the AND gate 154 will remain disabled, preventing staging of a subsequent vehicle.

The output of the AND gate 154 is connected to the adjustable one-shot 145 over line 155. The adjustable one-shot 145 is also connected so that a rising input signal on the line 155 generates a positive-going output pulse at its output over line 156. The adjustable one-shot 145 has a conventional external circuit (not shown) for adjusting the length of its output pulse, and there is also a by-pass circuit, here indicated in logical form by an AND gate 157, by which the adjustable one-shot may be by-passed entirely. The AND gate 157 is connected as shown to by-pass the adjustable one-shot 145, and has as its enabling input the fast launch signal on line 86.

The output of the adjustable one-shot 145 on line 156 is connected to the input of the yellow one-shot 146, the output of which forms the yellow output signal on line 28Y. The yellow one-shot 146 is also connected so that a rising input signal on the input line 156 generates a positive going pulse on the output line 28Y. The output of the yellow one-shot 146 is connected by line 158 to the clock terminal of yet another flip-flop, here designated the green flip-flop 159. As the yellow signal on line 28Y falls, the green flip-flop 159 will be set, producing an output signal on line 161, which is connected as one input to an OR gate 162, the output of which is the green light signal on the line 28G.

Another AND gate 163 has as its input the "start load" signal on the line 164, the inverse green signal from the green flip-flop 159, over line 165, and the inverse yellow signal from the yellow one-shot 146, over line 166. Thus, when the "start load" signal is high, indicating that the start beam 18 (FIG. 1) is broken, and when neither the yellow nor the green lights are on, the AND gate 163 generates an output signal on line 167, which is connected as an input to an OR gate 168, the output of which is the red light signal on the line 28R.

In summary, the light tree control logic illustrated in FIG. 6 operates in the following manner. When a first vehicle positions itself to break the start beam 18 (FIG. 1), a "start load" signal rises on line 66 and the AND gate 163 is opened, since neither the yellow nor the green light is on. Consequently, a high level signal is generated on the line 28R to light the red light. After the delay associated with the staging one-shot 144 has elapsed, the staging flip-flop 143 will be set, and the AND gate 154 will generate an output since, as will be seen, step 4 is the quiescent state of the control counter 48 (FIG. 2), and there will, therefore, be a "step 4" signal on line 73. Next, the adjustable one-shot 145, if not by-passed, will inject a further delay, after which the yellow one-shot 146 will generate a signal pulse on the line 28Y, lighting the yellow light and simultaneously extinguishing the red light. As the yellow signal on line 28Y falls, the green flip-flop 159 will be set, thereby generating a green light signal on the line 28G, and keeping the red light extinguished. On receiving the green light, the first vehicle will normally start, and the start beam 18 (FIG. 1) will be remade, resulting in a falling "start load" signal on line 66, which has the effect of setting the start flip-flop 141, clearing the staging flip-flop 143, and clearing the green flip-flop 159.

If a vehicle should start before a green light is given, this will be detected by an AND gate 169 having as its inputs the inverse output of the green flip-flop 159, over line 170, and the inverted "start load" signal over line 171. Thus, if a "start load" signal falls while the green flip-flop is not set, a rising signal level will be output from the AND gate 169 on line 172. This line 172 is connected to the input of the foul start one-shot 147 which generates a positive-going output pulse in response to the rising input signal level. The output of the foul start one-shot 147 is connected, in turn, as an input to the OR gate 162 over line 173, thereby forcing a momentary green signal output on the line 28G.

Note that the "allow start" signal on line is taken directly from the output of the green flip-flop 159, so that a foul start, although forcing a green signal, does not result in an "allow start" signal on line 74. Consequently, on foul starts, the appropriate segment of the memory 41 (FIG. 4) will not be started, and a zero time will be displayed for the foul-starting vehicle at the end of its lap.

It will be recalled that the "tree stop" signal, on line 84, is manually initiated to prevent further staging of vehicles. For this purpose, line 84 is connected as another input to the OR gate 168, thus generating an output red signal on the line 28R when the tree stop switch 83 (FIG. 2) is actuated. A signal on line 84, therefore, forces a red light condition, and is also connected to inhibit any staging operations in progress by, for example, clearing the start flip-flop 141 and forcing the output of the adjustable one-shot 145 to ground. These inhibiting functions have been omitted from FIG. 6 for clarity and are shown only by the line 174.

Figure 7:
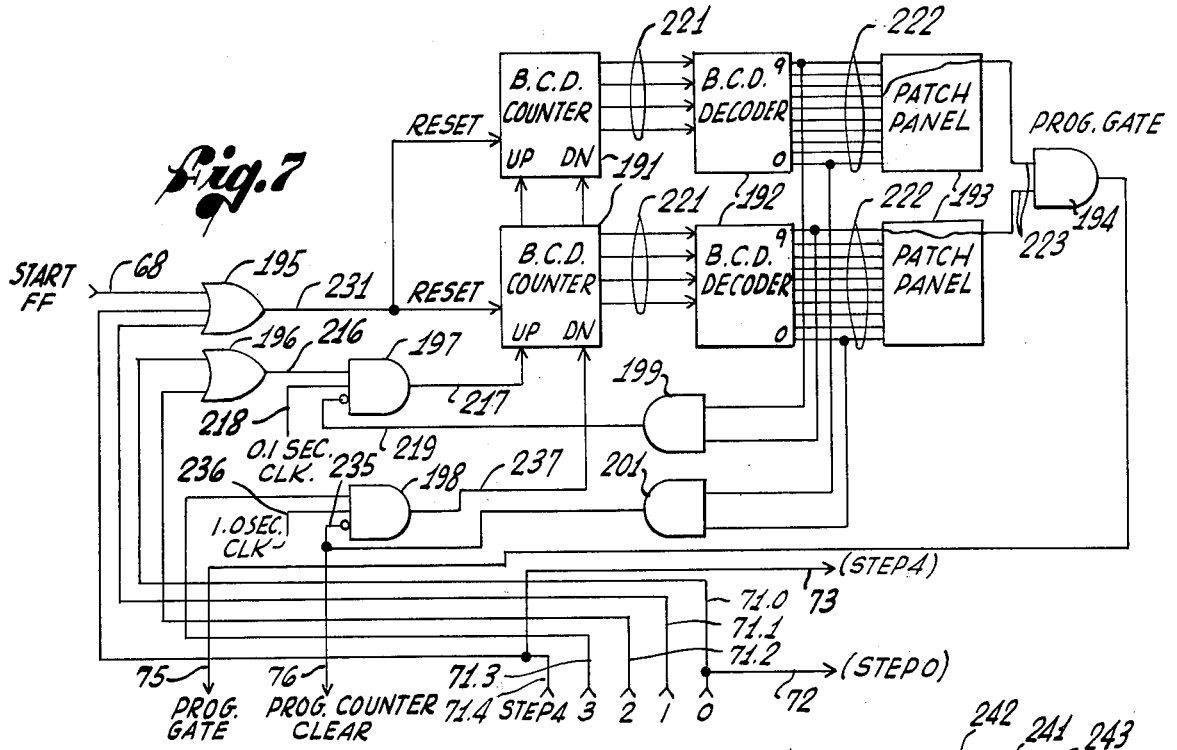
FIG. 7 is a logic diagram of the program counter included in FIG. 2.
Figure 8:
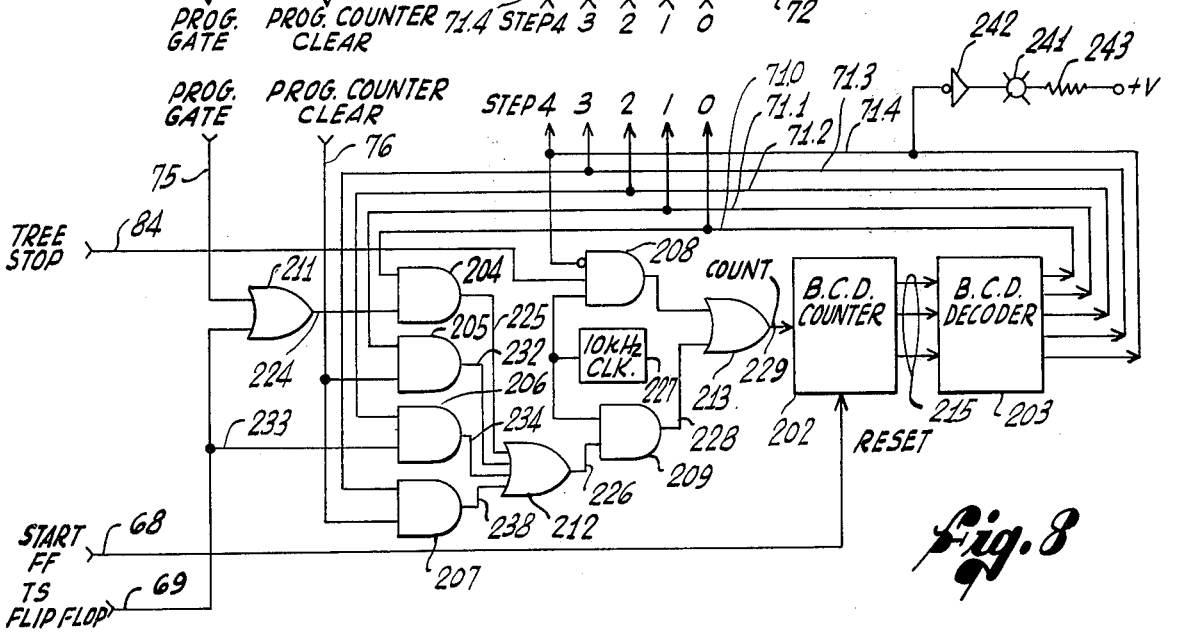
FIG. 8 is a logic diagram of the control counter included in FIG. 2.

Operations of the program counter 47 and the control counter 48 (FIG. 2), as illustrated in FIGS. 5 and 6 respectively, can best be described by reference to both FIGS. 7 and 8 together. As illustrated in FIG. 7, the program counter comprises a two-stage BCD counter 191, two BCD decoders 192, two patch panels 193, an AND gate designated the program gate 194, two OR gates 195 and 196, and four other AND gates, respectively designated the "up" AND gate 197, the "down" AND gate 198, the "program counter full" AND gate 199 and the "program counter clear" AND gate 201. The control counter illustrated in FIG. 8, comprises a BCD counter 202, a BCD decoder 203, six AND gates 204–209, and three OR gates 211–213. The BCD counter 202 contains a count indicating the current step of the delay sequence, either step 0, step 1, step 2, step 3 or step 4. This count is transferred over lines 215 to the BCD decoder 203, which generates an output on appropriate one of the five lines 71.0–71.4 to indicate the current condition of the control counter 202. The step signals on lines 71.0–71.4 are used by the program counter of FIG. 7 to control a sequence of operations on the two-stage counter 191, and the status of this counter as indicated by the program gate 194 and the "program counter clear" gate 201 are fed back to the control counter of FIG. 8 over lines 75 and 76 respectively.

In more detail, the "step zero" signal on line 71.0 is connected as an input to the OR gate 196, the output of which is connected over line 216 to an input of the "up" AND gate 197, which, in turn, has its output connected over line 217 to the upward counting terminal of the two-stage BCD counter 191. The other two inputs of the "up" AND gate 197 are a 0.1 second clock signal on line 218 and the inverse of a signal from the counter-full AND gate 199, on line 219, indicating that the counter is not yet full. Consequently, so long as the counter 191 is not full, the clock signals on line 218 will be gated to count the BCD counter 191 upwards during step zero. The contents of the BCD counter 191 is transferred to the decoders 192 over lines 221, and the output lines 222 from the decoders 192 are connected to the patch panels 193 so that only a particular, selected two-digit count will generate signals on lines 223 from the patch panels 193 to enable the program gate 194.

The resultant signal from the program gate 194 on line 75 is connected as an input to the OR gate 211, the output of which is connected by line 224 as an input to the AND gate 204, the other input of which is the "step zero" signal on line 71.0. Therefore, simultaneous presence of a "program gate" signal and a "step zero" signal will generate an output from the AND gate 204, which is connected as an input to the OR gate 212 over line 225, the output of which is, in turn, connected by line 226 as an input to the AND gate 209. A 10 kHz. clock signal, indicated by 227, is connected as a second input to the AND gate 209, and the output of the AND gate 209 is connected by line 228 to the OR gate 213, the output of which is connected, in turn, by line 229 to the count terminal of the BDC counter 202. Thus, when the "program gate" signal and the "step zero" signal are both high, the BCD counter 202 is advanced by one step to step 1.

The "step 1" signal on line 71.1 is connected as an input to the OR gate 195, the output of which is connected by a line 231 to the reset terminals of the two-stage BCD counter 191. The function performed during step 1, then, is to reset the BCD counter 191. The "step 1" signal is also connected an an input to the AND gate 205, the other input of which is the "program counter clear" signal on line 76. Therefore, when the two-stage BCD counter 191 is reset in step 1, the AND gate 205 produces an output on line 232. This line 232 is also connected as an input to the OR gate 212, and it will be apparent, therefore, that a signal on line 232 advances the BCD counter 202 a further step, to step 2.

The "step 2" signal on line 71.2 is connected as an input to the OR gate 196, as was the "step zero" signal on line 71.0. Consequently, the effect of step 2 is also to count upwardly in the two-stage BCD counter 191. This upward counting will continue until a "time sample flip-flop" signal is received on line 69. This signal is connected by line 233 as an input to the AND gate 206, the other input of which is the "step 2" signal on line 71.2, and the output of which is also connected to the OR gate 212 over line 234. Accordingly, when the time sample beam 23 (FIG. 1) is broken and remade, a signal from the time sample flip-flop on line 69 has the effect of advancing the BCD counter 202 a further step, to step 3.

The "step 3" signal on line 71.3 is connected as an input to the AND gate 198, a second input which is derived from the inverse of the "program counter clear" signal from the AND gate 201, over line 235, and a third input of which is a one-second clock signal 236. Consequently, the "up" AND gate 198 produces output clock pulses on line 237 provided the BCD counter 191 is not zero and a "step 3" signal is present on line 71.3. The line 237 is connected to the down-counting terminal of the BCD counter 191. In step 3, then, the BCD counter 191 is counted downwardly in one second steps until a zero count is reached. At this point, a "program counter clear" signal on line 76 is input to the AND gate 207, the other input of which is the "step 3" signal, and the output of which is connected by line 238 to the OR gate 212, thereby advance the BCD counter 202 to step 4. The "step 4" signal on line 71.4 is connected as an input to the OR gate 195, which, as was seen earlier, has its output connected over line 231 to reset the two-stage BCD counter 191. Thus, in step 4 the BCD counter 191 is reset to zero.

It will be recalled that the "step 4" signal is also directed over line 73 to initiate staging operations of a subsequent vehicle. When that vehicle has been started, the "start flip-flop" signal will appear on line 68, and this is connected as an input to the OR gate 195 to reset the BCD counter 192, and is also connected to the reset terminal of the BCD counter 202 to reset it to a "step zero" condition.

The "tree stop" signal on line 84 is connected as an input to the AND gate 208, the other inputs of which are the inverse of the "step 4" signal on line 71.4 and the 10 kHz clock 227. Thus, when the "tree stop" signal is present on line 84, this has the effect of stepping the control counter 202 until step 4 is reached.

It should also be noted that the "time sample flip-flop" signal is also connected as an input to the OR gate 211, the output of which, it will be recalled, is connected as an input to the AND gate 204, whose function it is to step the counter 202 from step 0 to step 1. Thus, if the time sample beam is broken and remade, by a very fast vehicle, before the program counter 47 reaches the delay selected at the patch panels 193, the control counter 43 will automatically advance to step 1, and thence to step 2, 3 and 4.

It will be apparent from the foregoing description that the program counter 47 (FIG. 2) operates to count upwardly in 0.1 second step until a fixed delay of as much as 9.9 seconds, as set in the patch panels 193 (FIG. 7), is reached. At this point, the program counter 47 (FIG. 2) is counted downwardly in one second steps until zero is reached, at which time the starting sequence of a subsequent vehicle is initiated. The delay time between vehicles is, therefore, given by the expression: 10 (sample time - fixed delay time). In addition, there is an adjustable staging delay caused by the adjustable one-shot 145 (FIG. 6).

The fixed delay time, set at the patch panels 193, is normally selected to be close to the sample time for a very fast driver over the sample distance. Consequently, if the difference given by the expression (sample time - fixed delay time) is zero or less, no further delay is required, since the vehicles are already spaced by one-tenth of the course distance. If the difference is positive, however, the vehicle being timed is slower than a very fast driver, and an additional delay of ten times the difference is timed out before allowing the next vehicle to start.

Another aspect of the invention is that it may be easily adapted to operate in a "test" mode for trouble shooting purposes. Manual controls (not shown) are provided to simulate the operation of the sensors 16, 17, 24 and 38 (FIG. 2) at the start, finish, and time sample positions. Furthermore, many of the counters and flip-flops in the system are connected to display devices such as light-emitting diodes, so that normal or simulated operation of the system may be conveniently monitored. One of these display devices is shown, by way of example, in FIG. 8. A light-emitting diode (LED) device 241 is shown connected to the "step 4" signal line 71.4, through an inverter 242, and the LED is supplied with power through a resistor 243. Thus, when the "step 4" signal is high, the LED 241 will be actuated.

The components used in the system of the present invention may be selected from a wide variety of commonly available discrete or integrated circuits. The following type numbers are exemplary only and relate to integrated circuits manufactured by Texas Instruments, Inc. Dallas, Texas:

| | |
|---|---|
| BCD counters 93, 94, 101, 102 111 and 202 | SN7490 (or multiples thereof) |
| BCD counters 191 | SN74192 |
| BCD decoders 125, 128, 129, 192 and 203 | SN7442 |
| Flip-flop 116 | 1/2 SN7400 |
| Flip-flops 141, 142, 143 and 149 | 1/2 SN74107 |
| One-shots 144, 145, 146 and 147 | 1/2 SN74123 |
| Register file 50 | SN74170 |
| AND, OR, and inverter logic | selected from SN74 series |

It will be appreciated from the foregoing that the timing system of the present invention provides to heretofore unavailable means for spacing vehicles sequentially started on a racing track, or for spacing contestants in a sporting event. In addition, the system includes the means for detecting foul starts, and measures and displays the times of the vehicles or contestants to an accuracy of 1/1000 of a second.

Although a particular embodiment of the invention has been described in detail herein for purposes of illustration, it will be appreciated by those of ordinary skill in the art that various modifications may be made without departing from the spirit and scope of the invention. Accordingly, the invention is not to be limited except as by the appended claims.

We claim:

1. Apparatus for sequentially starting and timing a plurality of participants traversing a designated course, said apparatus comprising:

sensing means for detecting the presence of participants at selected positions in the course;

timing means responsive to signals from said sensing means for determining for each participant a sample time measured over a selected portion of the course and a total time over the complete course;

control means for automatically starting the participants over the course at spaced time intervals derived from the respective sample times of immediately preceding participants, said control means including means for generating a control signal after a delay time derived from the sample time determined by said timing means, and means responsive to the control means for signaling a participant to start; and display means connected to said timing means, for automatically displaying the total time for each participant completing the course.

2. Apparatus as set forth in claim 1, wherein said timing means include:

a clock pulse generator;

pulse counting means selectively connectable to said clock pulse generator, for simultaneously measuring a plurality of total times for a like plurality of participants on the course; and additional pulse counting means for measuring the sample time for each participant.

3. Apparatus as set forth in claim 2, wherein said means for generating a control signal includes means for operating said additional pulse counting means in a reverse direction, and the delay time is derived from the sample time by operating said additional pulse counting means in the reverse direction.

4. Apparatus as set forth in claim 2, wherein said additional pulse counting means include means for automatically subtracting a selectable time delay from the measured sample time.

5. Apparatus as set forth in claim 1, wherein said means for signaling a participant to start include means for causing an adjustable time delay before signaling a participant to start.

6. Apparatus for sequentially starting and timing a plurality of participants around a special course, said apparatus comprising:

sensing means for detecting the presence of a participant at a start position, a finish position and a preselected intermediate position;

means coupled to said sensing means for timing each of the participants from the start position to the intermediate position;

staging control means for delaying starting of participants following a first participant, including means for signaling the participants to start at times determined in part from the times of corresponding immediately preceding participants to reach the intermediate position;

timing and storage means for accumulating time counts corresponding to elapsed times for all participants simultaneously on the course; and display means connected to said timing and storage means, for displaying the elapsed time of each participant reaching the finish position.

7. Apparatus as set forth in claim 6, wherein:

said means for timing the participants to reach the intermediate position include reversible counting means;

said staging control means include means for controlling said counting means, whereby said counting means is incremented at a certain rate to count clock pulses as a participant proceeds during a sample time from the start position to the intermediate position, and is decremented to zero at a slower rate to complete a delay sequence before releasing a subsequent participant; and said means for signaling the participants to start is operative in response to completion of the delay sequence.

8. Apparatus as set forth in claim 7, wherein said means for timing the participants to reach the intermediate position includes means for automatically timing out of a fixed time delay before said counting means is incremented to measure the sample time.

9. Apparatus as set forth in claim 7, wherein said means for signaling the participants to start include means for selectively including an additional time delay on completion of the delay sequence.

10. Apparatus as set forth in claim 7, wherein said staging control means include means for detecting "foul starts".

11. Apparatus as set forth in claim 7, including manually operable means for forcing said means for signaling participants to a stop condition to prevent further automatic starting of participants.

12. Apparatus as set forth in claim 6, wherein said timing and storage means include:

a plurality of clock pulse counters; and storage counter control means for initiating and terminating counting by said storage counter and for transferring signals from said storage counters to said display means; and storage counter selection means for selecting a particular storage counter, corresponding to a particular participant, for control by said storage counter control means.

13. Apparatus as set forth in claim 6, further including switching means for selecting signals from said sensing means to allow for travel by the participants in a reverse direction around the course.

14. Apparatus as set forth in claim 6, further including filtering means for eliminating spurious signals from said sensing means.

15. Apparatus as set forth in claim 6, wherein said display means include means for automatically blanking the display of an elapsed time after a selectable maximum time.

16. Apparatus as set forth in claim 6, further including:

means for holding the display of an elapsed time for a minimum time period; and buffer means for storing signals received from said sensing means at the finish position during the minimum time period, whereby the elapsed time for each participant is displayed for the minimum time even if a subsequent participant completes the course during the minimum time.

17. Electronic timing and control apparatus for use in timed motor vehicle racing over a special course, comprising:

sensing means at a start position, a finish position, and an intermediate sample position;

a plurality of lights at the start position to provide a starting signal to the drivers of the vehicles;

first timing means for performing a sequence of timing steps including measuring a selectably fixed time delay after each vehicle leaves the start position, measuring the remaining time taken by each vehicle to reach the intermediate position, and then measuring a further delay directly proportional to said remaining time;

first control means for switching said first timing means through its sequence of timing steps and generating a control signal when the sequence is complete;

second control means coupled with said sensing means at the start position, for controlling operation of said lights to start a vehicle on receiving said control signal from said first control means;

second timing means for measuring elapsed times for a plurality of vehicles on the course simultaneously, including storage means for holding the elapsed times;

storage control means for initiating and terminating timing operations in said storage means and for retrieving stored elapsed times from said storage means;

storage selection means for selecting an appropriate segment of said storage means for control by said storage control means; and display means for displaying the times retrieved from said storage means by said storage control means as vehicles complete the course and reach the finish position.

18. Apparatus as set forth in claim 17, further including means for detecting "foul starts" and for selectively suppressing operation of said second timing means for vehicles making "foul starts."

19. Apparatus as set forth in claim 17, further including manually operable control means for suppressing the start signal at said lights and for resetting said storage selection means.

20. For use in a vehicle timing system having at least one vehicle sensor, apparatus for filtering signals from the sensor to eliminate spurious signals below a threshold duration, said apparatus comprising:

a clock pulse generator;

a first counter enabled by the presence of a sensor signal to count pulses from said clock pulse generator and to generate a first output signal if the sensor signal persists for a first preselected time;

a second counter enabled by the absence of a sensor signal to count pulses from said clock pulse generator and to generate a second output signal if the sensor signal is absent for a second preselected time;

first counter control means for stopping said first counter in response to said first output signal and resetting said first counter in response to said second output signal; and second counter control means for stopping said second counter in response to said second control signal and resetting said second counter in response to said first output signal;

whereby presence of the sensor signal for the first preselected time will produce the first output signal, until the sensor signal is absent for the second preselected time and the second output signal is thereby generated.

21. A method of controlling the initial spacing between sequentially started racing vehicles on a designated course, comprising the steps of:

timing a vehicle over a selected portion of the course to obtain a measure of its speed;

delaying starting of a next vehicle by a time interval derived in part from the speed of the preceding vehicle and in part from at least one adjustable time delay; and repeating said timing step and said delaying step for successively started vehicles, whereby the initial spacing between any two consecutively started vehicles is controlled by said timing and delaying steps to obtain minimum spacing without subsequent interference between the vehicles.

22. A method of timing and controlling the initial spacing between racing vehicles started one by one on a special course, comprising the sequential steps of:

starting a first vehicle;

waiting for an adjustable time delay to elapse;

measuring a sample time taken for the first vehicle to reach an intermediate position in the course;

then waiting for a further period proportional to the sample time to elapse; and then initiating a starting sequence for a second vehicle, whereby the initial spacing between the first and second vehicles is controlled to obtain minimum spacing without subsequent interference between the vehicles.

23. A method as set forth in claim 22, wherein:

said first waiting step is effected by counting a time counter upwardly until the adjustable time delay is reached;

said step of measuring a sample time is effected by resetting the time counter to zero and counting it upwardly until the first vehicle reaches the intermediate position in the course; and said second waiting step is effected by then counting the time counter downwardly to zero.

* * * * *

UNITED STATES PATENT AND TRADEMARK OFFICE

CERTIFICATE OF CORRECTION

PATENT NO. : 4,074,117

DATED : February 14, 1978

INVENTOR(S) : Jack Z. DeLorean, et al.

It is certified that error appears in the above-identified patent and that said Letters Patent are hereby corrected as shown below:

Column 2, line 42, "sugsequent" should be --subsequent;

line 46, "vehiicle" should be --vehicle--;

line 58, the second occurrence of "the" should be --that--.

Column 10, line 65, after "line" insert --74--.

Column 12, line 7, "BDC" should be --BCD--;

line 53, after "212", insert --to--.

Column 13, line 17, "step" should be --steps--.

Column 14, line 6, "to" should be --a--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*